US005154534A

United States Patent [19]

Guerin et al.

[11] Patent Number: 5,154,534

[45] Date of Patent: Oct. 13, 1992

[54] PROCESS FOR MANUFACTURING GALVANIZED CONCRETE REINFORCEMENT RIBBON

[75] Inventors: Georges J. M. Guerin, La Celle St Cloud; Michel Temenides, St Germain en Laye, both of France

[73] Assignee: Sollac, Paris, France

[21] Appl. No.: 603,752

[22] PCT Filed: Apr. 10, 1990

[86] PCT No.: PCT/FR90/00259

§ 371 Date: Nov. 6, 1990

§ 102(e) Date: Nov. 6, 1990

[87] PCT Pub. No.: WO90/12175

PCT Pub. Date: Oct. 18, 1990

[30] Foreign Application Priority Data

Apr. 10, 1989 [FR] France ..... 89 04679

[51] Int. Cl.[5] ..... E01C 11/16

[52] U.S. Cl. ..... 404/70

[58] Field of Search ..... 404/27, 45, 68, 70-72, 404/28; 148/12 R, 14, 134, 155

[56] References Cited

U.S. PATENT DOCUMENTS

| | | | |
|---|---|---|---|
| Re. 31,221 | 4/1983 | Elias et al. | 148/337 X |
| Re. 31,306 | 7/1983 | Elias et al. | 148/12 F |
| 3,909,316 | 9/1975 | Hirata | 148/12 R X |
| 3,936,324 | 2/1976 | Uchida et al. | 148/134 X |
| 3,951,696 | 4/1976 | Gondo et al. | 148/12 R |
| 4,082,576 | 4/1978 | Lake et al. | 148/12.3 X |
| 4,104,088 | 8/1978 | Batz | 148/12 R |
| 4,183,983 | 1/1980 | Cook et al. | 427/327 |
| 4,400,223 | 8/1983 | Heitmann et al. | 148/12 F |
| 4,437,905 | 3/1984 | Nitto et al. | 148/16 |
| 4,478,892 | 10/1984 | Amberson | 427/320 |

FOREIGN PATENT DOCUMENTS

| | | |
|---|---|---|
| 418661 | 7/1910 | France . |
| 2325778 | 9/1975 | France . |
| 2345266 | 4/1976 | France . |
| 2560217 | 2/1985 | France . |
| 2579651 | 3/1985 | France . |
| 2605302 | 10/1986 | France . |
| WO86/05766 | 10/1986 | PCT Int'l Appl. . |

OTHER PUBLICATIONS

The Metallurgical Dictionary 1953 Reinhold Publishing Corp.-p. 234.

The Making, Shaping and Treating of Steel-p. 706, Seventh Edition, Second Impression ©1957, United States Steel.

*Primary Examiner*—Ramon S. Britts

*Assistant Examiner*—Roger J. Schoeppel

*Attorney, Agent, or Firm*—Fay, Sharpe, Beall, Fagan, Minnich & McKee

[57] ABSTRACT

According to a process for the manufacture of a framework (1) for reinforcing concrete structures and, in particular, concrete slab or shell structures in the form of a steel strip (3) with notched or goffered surfaces, a hot laminated sheet is used as a basis material having a width of between 1.5 and 6 mm, whereby said sheet is made of steel with a carbon content of less than 0.9%, and elastic limit of approximately 500 MPa. Said sheet is subjected to a cold lamination process at a strength-hardening level greater than 40% in order to obtain a sheet having, on the one hand, a thickness of between 0.8 and 2.5 mm, and on the other hand, an elastic limit greater than 700 MPa whereby the sheet is cut again so as to obtain a steel strip (3) which is then continuously notched or goffered. The application also concerns the framework obtained according to the process.

7 Claims, 1 Drawing Sheet

PROCESS FOR MANUFACTURING GALVANIZED CONCRETE REINFORCEMENT RIBBON

Figure 1:
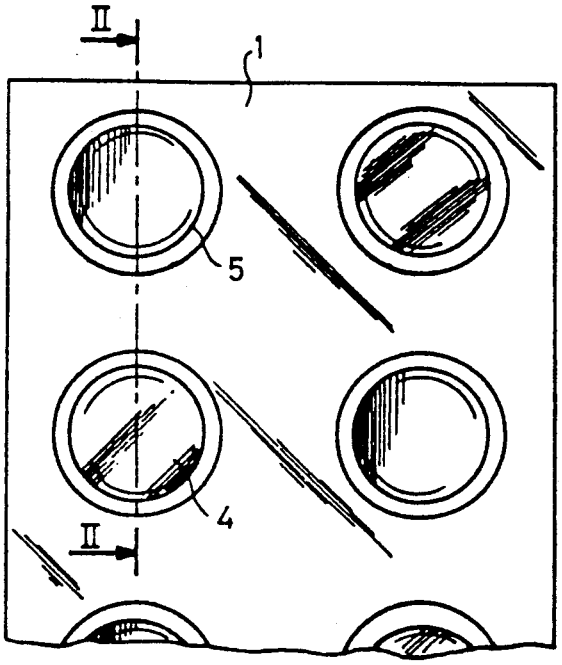

The subject of the present invention is a process for manufacturing a reinforcement for reinforcing concrete structures and, in particular, a concrete slab or web.

A further subject of the present invention is a reinforcement obtained according to this process.

FR A-2,579,651 discloses a reinforcing element which can be used for any continuous work of great length and, in particular, for concrete roads or roadways, which, while allowing continuous rapid and easy laying, also ensures increased resistance to transverse cracking for a reduced amount of metal reinforcement.

This reinforcing element takes the form of a relatively narrow and thin strip whose main faces are corrugated or notched.

The corrugating takes the form of an alternately projecting, delimiting protuberances and, hollow, delimiting depressions, relief. These protuberances and depressions can have the form of optionally truncated cones or pyramids or any other suitable form, such as a cylindrical or parallelepipedal form. The height of the protuberances or depressions relative to the adjacent surface is preferably approximately 5 to 80% of the thickness of the metallic ribbon.

The metallic ribbon is made from steel with a high elastic limit, for example, having a tensile strength greater than 800 MPa, and, preferably, has a thickness of 0.8 to 2.5 mm and a width of 10 to 60 mm.

Moreover, the corrugating can be obtained by stamping or notching, if appropriate in the hot state.

FR-A-2,579,651 also describes a process for manufacturing a corrugated or notched metallic ribbon such as defined above, which process consists in passing a metallic ribbon, in the form of a flat band between at least one pair of rolls whose working faces comprise, respectively, hollow and projecting imprints corresponding to those which it is desired to impart onto the metallic ribbon.

In order to give the said metallic ribbon the desired mechanical properties, before corrugating or notching, it is subjected to a patenting treatment and, after corrugating or notching, to a treatment which increases resistance to corrosion, such as pickling followed by a phosphate treatment.

Such a reinforcing element and the process for producing it possess various drawbacks.

In fact, the metallic ribbon is made from steel with a high elastic limit and, consequently, it cannot be galvanized, which means that it has to be subjected to a phosphate treatment in order to protect it against corrosion.

Moreover, this steel cannot be welded and thus does not permit, for example, the manufacture of trellises.

The invention aims to remedy these drawbacks while retaining the advantages of a flat element for reinforcing a concrete structure.

The subject of the invention is a process for manufacturing a reinforcement for reinforcing concrete structures and, in particular, a concrete slab or concrete web, characterized in that the base material used in a hot-rolled sheet with a thickness of between 2.5 and 6 mm, made from steel having a carbon content lower than 0.9% and an elastic limit of approximately 500 MPa, which is subjected to cold rolling at a cold-working rate greater than 40% in order to obtain a sheet having, on the one hand, a thickness of between 0.8 and 2.5 mm, and, on the other hand, an elastic limit greater than 700 MPa, the sheet being cut in order to obtain a metallic ribbon which is then corrugated or notched continuously.

A steel with a low carbon content which is below 0.9% and has an elastic limit within the range 250–500 MPa cannot be used in reinforcing a concrete except by excessively increasing the density of the metal reinforcement. For this reason, according to the invention, steel with a low carbon content and an elastic limit of the order of 500 MPa is subjected to cold rolling at a cold-working rate greater than 40% in order to obtain the mechanical characteristics necessary for the use thereof, in an acceptable density, in reinforcing concrete structures.

According to the invention, the use of a steel with a low carbon content makes it possible to obtain a reinforcement which can be welded in order to produce complex structures.

In fact, when using sheet reinforcement, it is thus possible to butt weld the reinforcements unrolled in parallel.

According to a particular feature of the invention, the cold-rolled sheet is galvanized, which ensures good protection against corrosion, in particular when the sheet is subjected to pitting or scoring. This protection is better than a phosphate treatment.

According to another particular feature of the invention, the galvanized sheet is subjected to recovery annealing at a temperature between 480° C. and 520° C.

According to yet a further particular feature of the invention, recovery annealing is performed in a controlled nitrogen and hydrogen atmosphere.

The subject of the present invention is a reinforcement for reinforcing concrete structures characterized in that it is obtained by means of the abovementioned process and in that it has, at its ends, a cutout permitting the insertion of a joining piece.

The cutout permits a mechanical joint with one end of another reinforcement placed end on, the joining piece being fitted into the cutouts placed on top of one another.

According to a particular feature of the invention, the cutout forms at least one cylindrical hole placed in the longitudinal axis of the reinforcement, the joining piece therefore being a rivet or a clip.

According to another particular feature of the invention, the cutout forms at least one notch, made in the side of the reinforcement, and in which it is possible to insert a joining means formed, for example, by a band of steel folded into a U.

A further subject of the invention is a concrete slab or concrete web, characterized in that the reinforcing elements consist of reinforcements according to the invention.

A further subject of the invention is an underlayer for a roadway made from lean concrete or gravel stabilized with a binder in which are inserted, for reinforcing, reinforcements according to the invention.

Figure 2:
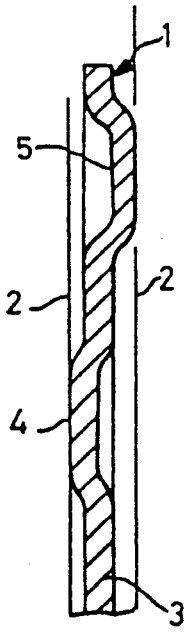
Figure 3:
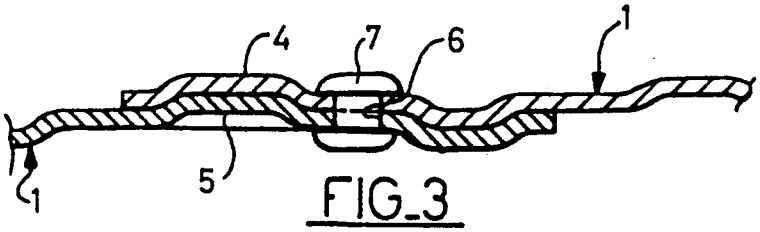
Figure 4:
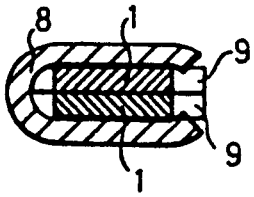
Figure 5:
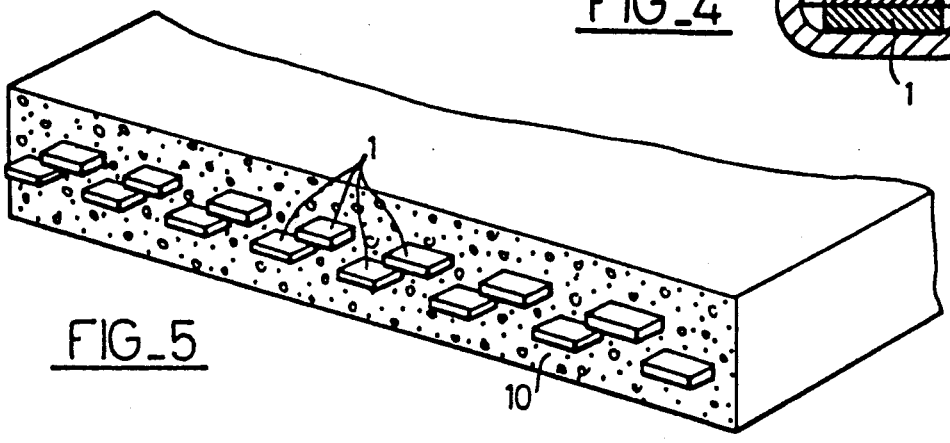

The invention will be described in greater detail below with reference to the appended drawings which are given solely by way of example and in which:

FIG. 1 shows a plan view of a part of a reinforcement according to the invention, FIG. 2 is a sectional view along the line 2—2 in FIG. 1, FIG. 3 shows a particular example of a join between two reinforcement ends, FIG. 4 shows another method for joining two reinforcements, FIG. 5 shows, in perspective, a slab reinforced by reinforcements according to the invention.

The process for manufacturing a reinforcement 1, as shown in FIGS. 1 and 2, for reinforcing concrete structures consists in using a base material consisting of a hot-rolled sheet with a thickness of 1.5 to 6 mm made from cladding and converting steel whose elastic limit is less than 500 MPa. In order to obtain a material which has an elastic limit greater than 700 MPa, the sheet is cold rolled at a cold-working rate greater than 40%. After cold rolling, the sheet is reduced to a thickness of between 0.8 and 2.5 mm.

Because of the properties of the base material, such a sheet can be welded and, moreover, the cold-rolling treatment gives it mechanical properties comparable with those of a so-called hard steel whose elastic limit is between 600 and 800 MPa.

In order to ensure protection against corrosion, the cold-rolled sheet is galvanized.

On the galvanizing line, annealing is performed in order to obtain a recovery of the rolled steel without causing a recrystallization and while retaining a level of stretch and of hardness which is virtually unchanged relative to the steel rolled before annealing.

Recovery annealing temperatures are between 480° and 520° C. The duration of the retreatment in a controlled $N_2$ and $H_2$ atmosphere is approximately 30 seconds.

The corrosion protection of a galvanized steel is greater than corrosion protection of a phosphate-treated steel, particularly in the use of a steel forming part of the construction of public works such as, for example, roads, such constructions suffering, inter alia, form the effects of alkaline products which are distributed in winter to combat freezing.

The sheet which is cold rolled and then galvanized is cut into a band so as to obtain metallic ribbons with a width of between approximately 10 and 60 mm.

The reinforcement 1 according to the invention is produced by corrugating, by stamping, or by notching the metallic ribbon so as to form protuberances projecting on one face, corresponding to depressions on another face. This shaping can be carried out cold.

As shown in FIGS. 1 and 2, the thickness of the base sheet cold rolling is shown by the fine lines 2, and after stamping of the metallic ribbon 3, obtained by cutting the said sheet into a band, the reinforcement 1 has corresponding projections 4 and hollows 5 with a diameter of approximately 3 m distributed uniformly over its entire surface.

Due to interlocking, the projections 4 have the advantage of stopping the phenomenon of unwinding, due to elasticity, of the coiled reinforcements. The reinforcement 1 has, at its ends, a cutout permitting the insertion of a joining piece.

According to a first embodiment shown in FIG. 3, the cutout forms at least one cylindrical hole 6 placed in the longitudinal axis of the reinforcement 1, and the joining piece is formed by a rivet 7.

The rivet 7 is placed between two ends of a reinforcement 1 so as to ensure continuity of the metal reinforcement, for example in a reinforced concrete slab and, to this end, the hole 6 is produced in the two joined reinforcements for the passage of the body of the rivet 7.

According to another example of a join between two reinforcements 1 shown in FIG. 4, notches 9 are cutout on the side of the said reinforcements 1. There notches may be rectangular or trapezoidal and their depth is substantially equal to the thickness of a joining means 8.

The notches 9 are superposed so as to insert the joining means 8 which, in this illustrative embodiment, is formed by a band of steel folded into the shape of a U. The join is ensured by squashing the two lips of the U.

The reinforcement 1 thus produced can be used, in particular, for the construction of concrete roadways as shown in FIG. 5.

The reinforcement 1 is then embedded in the concrete 10 parallel to the longitudinal axis of the roadway in one or more sheets parallel to the surface of the latter.

The amount of metal reinforcement as a percentage of the cross-section of the road is preferably 0.15 to 0.5%, this amount having to be regarded as the ratio between the cross-section of steel and the cross-section of concrete in a plane perpendicular to the longitudinal axis of the road.

The reinforcements 1 can also be spot welded. It is thus possible to produce welded trellises covering larger surfaces.

The reinforcement 1 can also be used to reinforce a lean concrete or gravel stabilized with a binder for an underlayer of the roadway, which enables macro-cracking and decomposition initiators to be eliminated.

The use of reinforcements according to the invention, which can be unwound in great lengths without permanent detrimental deformation and joined or welded together, makes it possible, on the one hand, to obtain continuous advancement of the site, consequently with improved quality, and, on the other hand, to greatly reduce the length of road occupied by the site and thus similarly to reduce the disruption caused to traffic in the event of a reinforcement or a renewal of an existing road or roadway, while ensuring protection against corrosion which is particularly effective against alkaline products distributed over the roadways in winter.

We claim:

1. Process for manufacturing a reinforcement particularly adapted for reinforcing concrete structures, a concrete slab or a road or roadway, the reinforcement taking the form of a metallic ribbon whose faces are notched or corrugated, characterized in that the reinforcement used comprises a base material formed by a hot-rolled sheet with a thickness of between 1.5 and 6 mm, made from steel having a carbon content lower than 0.9%, and an elastic limit of approximately 500 MPa, which is subjected to cold rolling at a cold-working rate greater than 40% in order to obtain a sheet having, on the one hand, a thickness of between 0.8 and 2.5 mm. and, on the other hand, an elastic limit greater than 700 MPa, the sheet being cut in order to obtain a metallic ribbon (3) which is then notched or corrugated continuously and galvanized.

2. Process according to claim 1, characterized in that the galvanized ribbon is subjected to recovery annealing at a temperature of between 480° C. and 520° C.

3. Process according to claim 2, characterized in that the recovery annealing is performed in a controlled nitrogen and hydrogen atmosphere.

4. A process for manufacturing a metallic ribbon for reinforcing concrete slabs and concrete webs, the process comprising the steps of:

hot rolling a sheet of steel having a carbon content lower than 0.9% and an elastic limit of approximately 500 MPa to a thickness of between 1.5 and 6 mm;

cold rolling the sheet at a cold-working rate greater than 40% in order to obtain a sheet having a thickness between 0.8 and 2.5 mm and an elastic limit greater than 700 MPa;

cutting the sheet to form metallic ribbons;

continuously embossing the ribbons to form bumps and cavities therein; and, galvanizing the ribbons.

5. The process of claim 4 further comprising the step of recovery annealing the ribbons, said step of recovery annealing being performed after said step of galvanizing.

6. The process of claim 5 wherein said step of recovery annealing is carried out at a temperature between 480° C. and 520° C.

7. The process of claim 5 wherein said step of recovery annealing is performed in a controlled hydrogen and nitrogen atmosphere.

* * * * *